United States Patent [19]

Troup, deceased et al.

[11] Patent Number: 4,681,259

[45] Date of Patent: Jul. 21, 1987

[54] ROTARY DRIVE SPRINKLER

[75] Inventors: Edward M. Troup, deceased, late of Mt. Baldy, by Cathryn H. Troup, legal representative; Giles A. Kendall, Azusa; Joseph U. Han, Glendora; Christopher M. Moralez, Temple City; Calvin A. Gongwer, Glendora, all of Calif.

[73] Assignee: Anthony Manufacturing Corp., Azusa, Calif.

[21] Appl. No.: 811,931

[22] Filed: Dec. 19, 1985

[51] Int. Cl.[4] ..... B05B 3/04

[52] U.S. Cl. ..... 239/206; 239/228; 239/239; 239/263; 239/288.5

[58] Field of Search ..... 239/203–206, 239/228, 230, 231, 232, 233, 237, 239, 246, 263, 264, 288–288.5, 589; 385/255

[56] References Cited

U.S. PATENT DOCUMENTS

| | | | |
|---|---|---|---|
| 2,192,483 | 3/1940 | Augustine et al. | 384/255 |
| 2,805,098 | 9/1957 | Hurley | 239/239 X |
| 3,070,315 | 12/1962 | Landry | 239/239 X |
| 3,702,678 | 11/1972 | Hauser | 239/239 X |
| 4,432,495 | 2/1984 | Bruninga | 239/206 X |
| 4,509,686 | 4/1985 | Larsen | 239/239 |

FOREIGN PATENT DOCUMENTS

| | | | |
|---|---|---|---|
| 2551655 | 6/1977 | Fed. Rep. of Germany | 239/206 |
| 1421963 | 1/1976 | United Kingdom | 239/206 |

*Primary Examiner*—Andres Kashnikow

*Attorney, Agent, or Firm*—Kelly, Bauersfeld & Lowry

[57] ABSTRACT

An improved rotary drive sprinkler is provided for driving a sprinkler spray head in a rotary stepping motion to deliver irrigation water over a prescribed terrain area. The rotary sprinkler comprises a pop-up stem assembly carrying the spray head and movable within a sprinkler housing between a normal retracted position and an elevated spraying position when water under pressure is supplied to the sprinkler housing. During operation, the water flowing through the sprinkler housing powers a piston drive assembly including a spring-loaded drive piston which is alternately subjected to a predetermined pressure differential and normalized pressure to displace the piston in a reciprocating manner. The drive piston is coupled to a motion converter assembly for converting the reciprocal motion of the drive piston to an oscillatory rotary motion which is coupled in turn via a reversible one-way clutch assembly to the pop-up stem assembly. The clutch assembly can be set to rotate the pop-up stem assembly and spray nozzle carried thereby in one direction in a series of small rotational steps through continuous full-circle rotation or, in the alternative, reversible rotation between adjustably set end limits of a selected arcuate path.

71 Claims, 26 Drawing Figures

ROTARY DRIVE SPRINKLER

BACKGROUND OF THE INVENTION

This invention relates generally to irrigation sprinklers of the type having a spray head rotatably driven in steps through a full-circle or selected part-circle arcuate path. More particularly, this invention relates to a rotary drive sprinkler having improved rotary drive means for indexing the spray head at a substantially constant stepping rate irrespective of water pressure supplied to the sprinkler, and wherein the drive means is designed for reliable long-term operation without accumulation of grit and the like.

A variety of rotating spray head sprinklers are well known in the irrigation art and typically include a sprinkler housing with a rotatable spray head adapted for connection to a supply of water under pressure. The spray head includes a nozzle oriented for outward passage of a stream of water under pressure normally in an upwardly angled and laterally outward direction for irrigation of a surrounding terrain area. A suitable drive means is provided for rotating the spray head through a full-circle rotational path or reversibly between adjustable end limits of a part-circle arcuate path, frequently in stepwise increments to change the azimuthal direction of the projected water stream.

In many rotating water sprinklers, it has been desirable to mount the rotary drive means in a protected position encased within the sprinkler housing to minimize contact with environmental elements and conditions, such as sand, grit, wind, and the like. Such sprinklers have commonly included rotary water-driven turbines or the like for indexing the spray head via a reduction drive gear train. In some of these sprinklers, ball-drive mechanisms or other intermittent motion devices are used to provide stepwise driving of the spray head. See, for example, the rotary drive sprinklers depicted in U.S. Pat. Nos. 3,930,618, 4,026,471, 4,253,608, and 4,417,691.

One disadvantage encountered with rotating water sprinklers of the above-described general type, however, is that the rotary driving or stepping speed as well as the magnitude of each rotational increment tend to be direct functions of water pressure supplied to the sprinkler. This functional relationship can result in significant variations in the application of irrigation water by a plurality of sprinklers within a common irrigation system due, for example, to water pressure variations incidental to terrain elevational differences and the like. Moreover, when the water pressure is relatively high, the sprinklers can experience relatively high rotational driving speeds which can cause significant internal wear of moving parts and thereby increase requirements for mechanical repair and replacement. Still further, over time, rotary drive sprinklers with internally-mounted drive mechanisms are subject to clogging by accumulating water-entrained grit and the like, resulting in operational failures.

There exists, therefore, a significant need for an improved rotary drive sprinkler of the type having rotary drive means protectively encased within a sprinkler housing, wherein the rotary drive means is adapted for substantially constant rate spray head stepping motion irrespective of water supply pressure and wherein the drive means is substantially unaffected by dirt or grit within the water supply. The present invention fulfills these needs and provides further related advantages.

SUMMARY OF THE INVENTION

In accordance with the invention, an improved rotary drive sprinkler includes a spray head rotatably driven in a series of relatively small rotational steps by a water-powered piston drive assembly. The piston drive assembly indexes the spray head through continuous full-circle rotation or reversibly between selected end limits of a part-circle arcuate path, with the stepping rate and angular magnitude of the steps being substantially constant throughout a broad range of normal water inlet supply pressures. A stream of irrigation water is projected outwardly from the spray head to irrigate surrounding terrain area.

In accordance with a preferred form of the invention, the improved rotary drive sprinkler comprises a generally hollow spinkler housing having a lower water inlet. The spray head is carried by a pop-up stem assembly biased normally by a retraction spring to a retracted position within the sprinkler housing but movable to a spraying position with the spray head elevated above the sprinkler housing upon admission of water under pressure to the sprinkler housing interior. Water supplied to the sprinkler housing flows through the lower water inlet into communication with a pressure reduction assembly which divides the water flow into a first portion substantially at line pressure and a second portion at a reduced reference pressure. A reduction valve forming part of the pressure reduction assembly maintains the pressure differential between the first and second water flow portions at a substantially constant magnitude irrespective of line pressure.

The first and second water flow portions are supplied to opposite sides of a drive piston forming an integral part of the piston drive assembly. The pressure differential displaces the drive piston in one direction against a piston biasing spring and in a direction increasing spring forces applied to a relief vale to open the relief valve at the end of a predetermined drive piston stroke. The opened relief valve unloads the line pressure from the drive piston, thereby permitting return piston displacement through an opposite stroke under the influence of the piston spring together with reclosure of the relief valve. The drive piston is thus reciprocated at a predetermined rate and substantially independent of line pressure by the alternating action of the pressure differential and the piston spring.

The drive piston is coupled to a motion converter assembly for converting the piston reciprocation to an oscillatory rotary motion. This oscillatory rotary motion is linked in turn through a reversible one-way clutch assembly to the pop-up stem assembly carrying the spray head. The oscillatory rotary motion is thus transmitted in one direction by the clutch assembly to index the pop-up stem assembly and spray head in one direction in small rotary steps, whereas rotary motion in the opposite direction causes the clutch assembly to override without driving the pop-up stem assembly.

A reversing trip mechanism is included as part of the one-way clutch assembly to selectively reverse the direction of rotary drive and override coupling with the pop-up stem assembly. If desired, the reversing trip mechanism can be set for continuous full-circle rotation of the pop-up stem assembly and spray head in either rotational direction. Alternately, trip dogs on the clutch assembly can be provided for reversing the setting of the trip mechanism upon rotation of the pop-up stem assembly to the end limits of a preselected arcuate path, wherein the position of the trip dogs can be adjustably set for reversible spray head rotation within a selected arcuate path.

In accordance with further features of the invention, the spray head of the improved rotary drive sprinkler includes an improved spray nozzle designed for rapid assembly and removable installation and further adapted for improved projected water stream range and distribution. In addition, the piston drive assembly and pop-up stem assembly cooperate during sprinkler operation to induce turbulent water flows within selected regions of the sprinkler housing to sweep away grit or debris which might otherwise accumulate and interfere with proper sprinkler operation. Still further, the improved sprinkler includes a simplified yet rugged sprinkler housing construction with a resilient protective cap co-molded onto the spray head. An improved trip mechanism for positive reversing action may also be provided, as well as a simplified inlet control valve provided as part of the pressure reduction assembly to control water inflow to the sprinkler housing.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
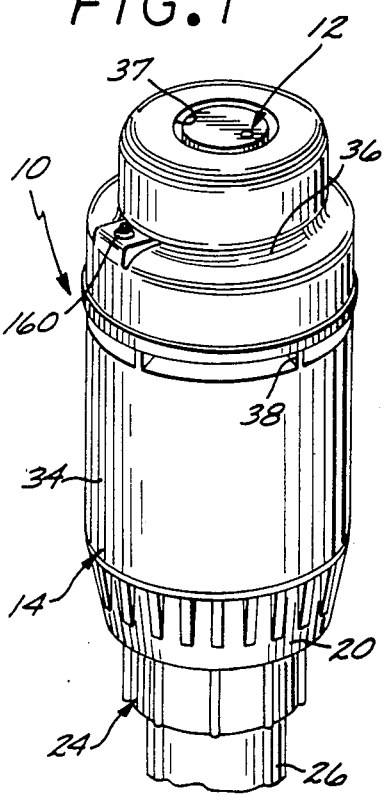
FIG. 1 is a perspective view illustrating an improved rotary drive sprinkler embodying the novel features of the invention.
Figure 3:
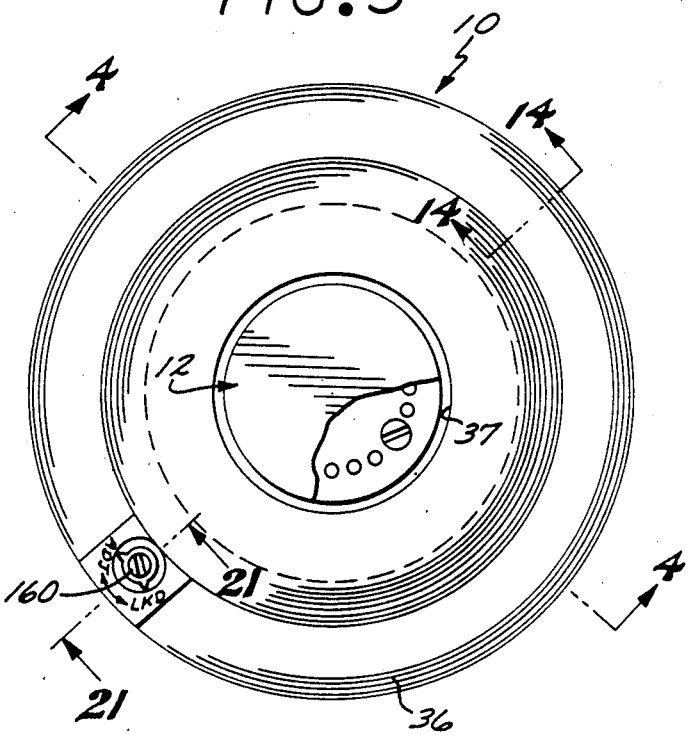
FIG. 3 is an enlarged top plan view of the sprinkler of FIG. 1, with portions broken away to illustrate construction details of the spray head.
Figure 2:
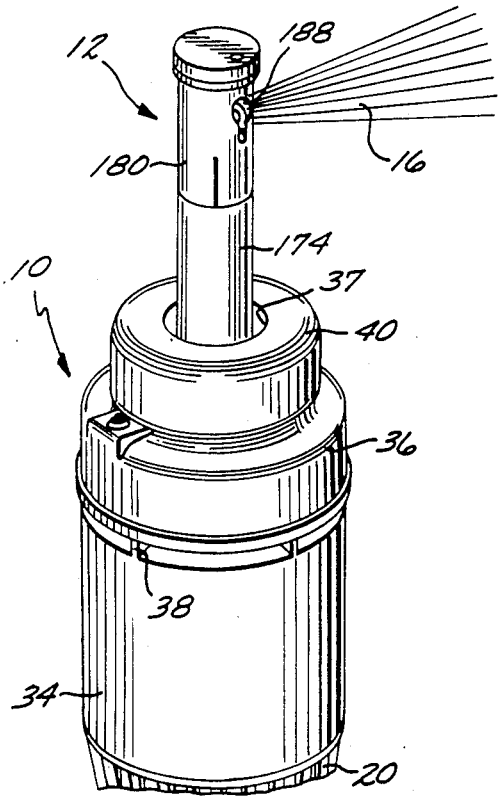
FIG. 2 is a fragmented perspective view illustrating the rotary drive sprinkler with a spray head in an elevated spraying position.

As shown in the exemplary drawings, an improved rotary drive sprinkler is referred to generally by the reference numeral 10. As shown in FIGS. 1 and 2, the rotary drive sprinkler 10 includes a spray head 12 movable between a normal inoperative position retracted substantially within a sprinkler housing 14 (FIG. 1) and an elevated spraying position (FIG. 2) spaced above the sprinkler housing to deliver a stream 16 of irrigation water in an outward direction. A piston drive assembly 18 (FIG. 4) is provided within the sprinkler housing 14 for rotatably driving the spray head 12 in a series of relatively small rotational increments through a continuous full-circle rotation in either direction or reversibly within a selected part-circle arcuate path.

The improved rotary drive sprinkler 10 of the present invention advantageously drives the spray head 12 in a stepwise manner and at a substantially constant stepping rate and angular step displacement irrespective of the line pressure of water supplied to the sprinkler housing 14. More specifically, the piston drive assembly 18 is hydraulically powered by a controlled pressure differential within the sprinkler housing wherein this pressure differential is substantially independent of water supply line pressure coupled to the sprinkler housing throughout a broad range of normal sprinkler operating pressures. The rotational stepping rate and the angular displacement of each step can thus be controlled to correspondingly control irrigation water coverage of surrounding terrain in a more accurate manner, and without requiring the use of separate pressure regulator devices and the like. In addition, the improved rotary drive sprinkler has a rugged yet relatively simplified construction and further includes an improved spray nozzle geometry for enhanced stream range and overall distribution of the water stream 16. The piston drive assembly 18 is further designed to create vacuuming or turbulent water flow action within selected regions of the housing interior to prevent accumulation of sand or other grit and debris which could otherwise interfere with proper operation of the sprinkler.

The sprinkler housing 14 of the rotary drive sprinkler 10 is constructed from interconnected housing components defining a hollow housing interior, with the housing components being formed preferably from a lightweight yet rugged molded plastic material or the like. More specifically, as depicted in one exemplary form in FIGS. 1–5, the sprinkler housing 14 comprises a lower inlet case 20 of generally cylindrical shape and defining a lower water inlet 22. The lower case 20 further includes an internally threaded inlet fitting 24 aligned with the inlet 22 for facilitated connection to a water supply line or riser 26 through which a supply of water under pressure is controllably provided to the sprinkler housing. As shown best in FIG. 4, this inlet fitting 24 is desirably formed with a concentric double-wall construction including a central ring 27 connected between inner and outer concentric cylindrical walls 28 and 29, with annular arrays of radially projecting upper and lower webs 30 and 31 also interconnected between the walls 28 and 29 to provide a high degree of structural rigidity. This double-wall/double-web construction for the inlet fitting 24 provides a sturdy fitting structure without requiring reinforcing rings of metal bands or the like as used commonly with many prior art sprinklers in certain types of installations, such as athletic fields and the like.

The lower inlet case 20 includes an outwardly projecting annular flange 32 near its upper end for seated reception of a cylindrical central case 34 of the sprinkler housing. The central case 34 terminates in turn at its upper end with an outer thread for engagement with an internally threaded cylindrical cover 36 having an upper central opening 37 within which the spray head 12 is seated in the retracted position (FIG. 1). Outwardly protruding ribs 38 on the central case 34 beneath the outer thread thereon provide rigid stops engaged by the lower end of the cover 36 to halt rotational movement of the cover onto the central case in a predetermined rotational position. A hood 40 comprising a resilient elastomer or the like is co-molded upon a skeletal frame 42 of plastic material or the like and partially exposed within the hood for direct adhesive attachment to a reduced diameter upper end of the cylindrical cover 36. The resilient hood 40 is thus upwardly exposed to absorb impacts and protect the sprinkler housing, for example, when the housing is buried within an athletic field or the like with the upper end of the hood 40 substantially flush with the ground surface.

Figure 4:
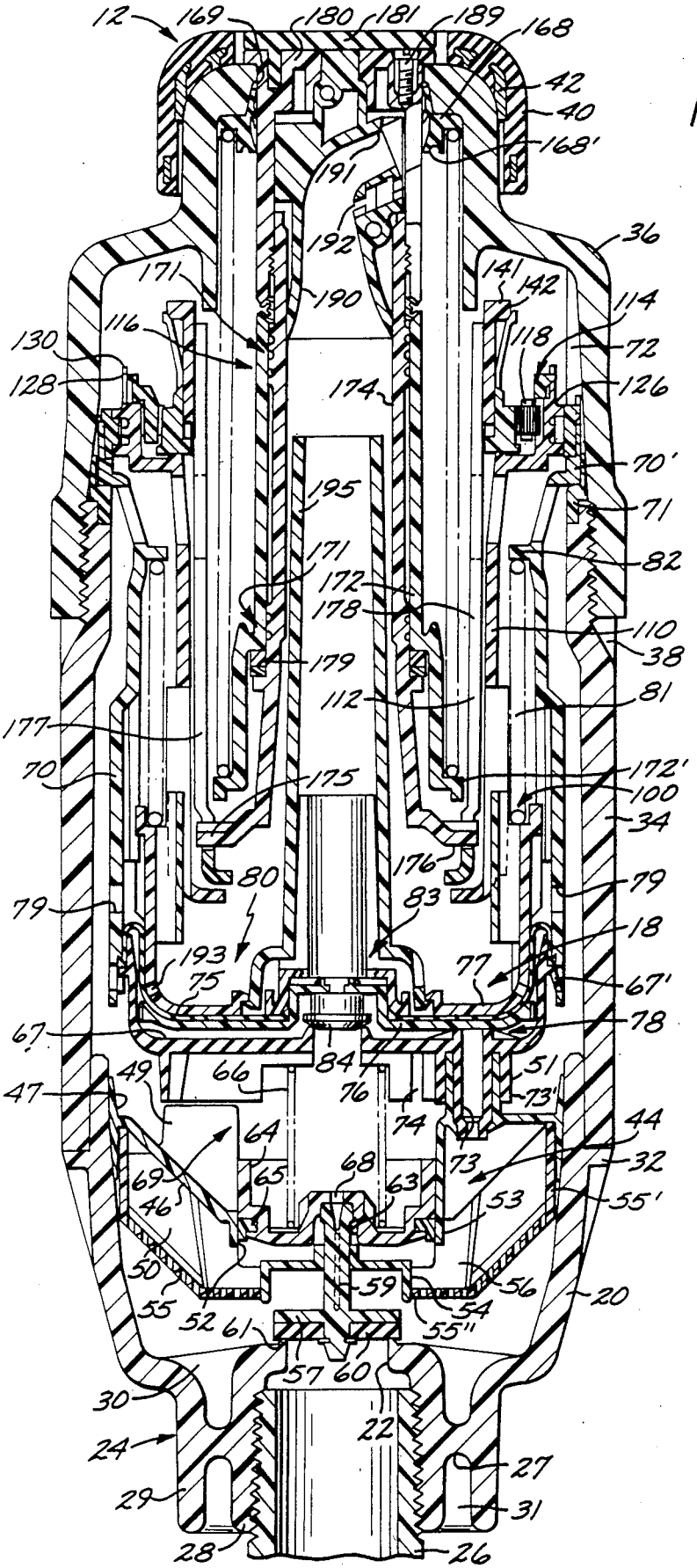
FIG. 4 is an enlarged vertical sectional view taken generally on the line 4—4 of FIG. 3 and illustrating the spray head in a normal retracted position substantially within a sprinkler housing.
Figure 5:
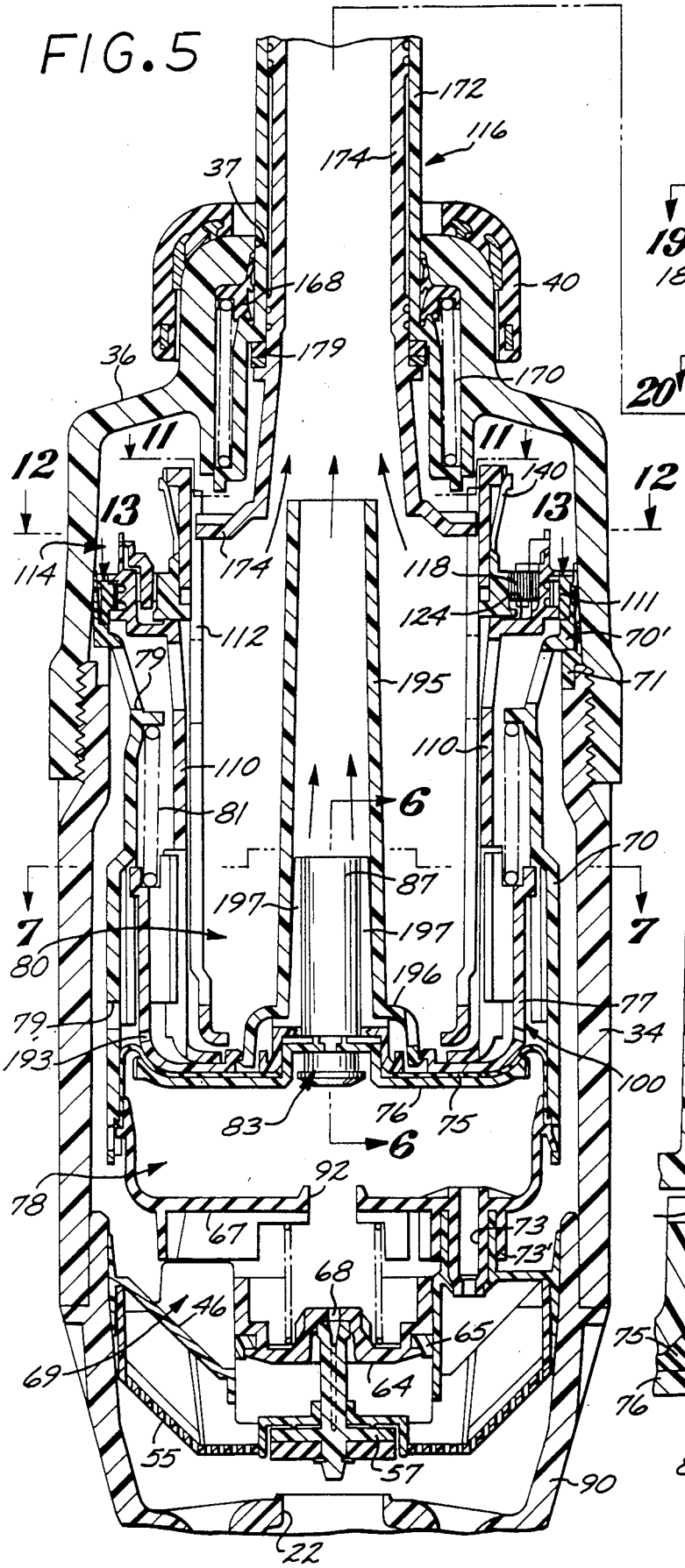
FIG. 5 is an enlarged fragmented vertical sectional view similar to FIG. 4 but illustrating the spray head in the elevated spraying position.
Figure 5:
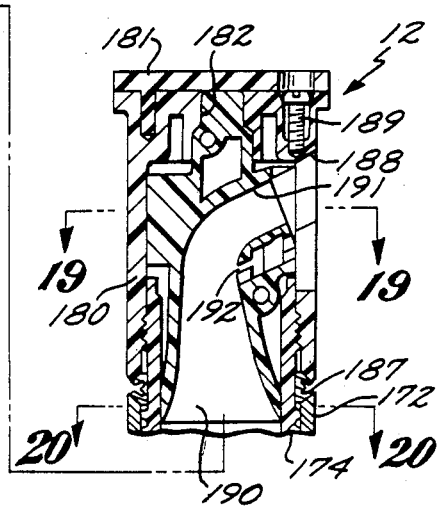

As shown in FIGS. 4 and 5, a pressure reduction assembly 44 is installed within the lower case 20 of the sprinkler housing 14 at a position immediately above the lower water inlet 22. This pressure reduction assembly 44 responds to incoming water flow under pressure to provide a controlled fluid pressure differential to the piston drive assembly 18 which responds, as will be described, to index the spray head 12 in a series of small rotational steps.

The illustrative pressure reduction assembly 44 comprises a generally cup-shaped case 46 including an outer cylindrical rim 47 sized to fit with relatively close tolerance into the upper end of the lower housing case 20. The cup-shaped case 46 extends radially inwardly and axially downwardly from the rim 47 and further includes upper and lower support fins 49 and 56 for respective supporting engagement with adjacent structures, as will be described. The case 46 further includes an annular array of preferably three upwardly open bypass sleeves 51, one of which is shown in the sectional views of FIGS. 4 and 5. A central opening 52 in the case 46 is lined by a smooth-surfaced and axially extending pressure reduction wall 53. The lower ends of the lower support fins 56 protrude downwardly beyond this reduction wall 53 and carry a downwardly spaced and open, disk-shaped valve receptor 54 spaced a short distance above the lower water inlet 22.

The reduction assembly case 46 is installed into the sprinkler housing 14 along with a cup-shaped filter screen 55 of molded plastic or the like and perforated to prevent upward travel of relatively large water-entrained debris into the sprinkler housing. This filter screen 55 includes a peripheral skirt 55' for press-fit reception into the case 46 within the outer rim 47. The screen 55 further includes a central opening 55'' for close seating therewithin of the valve receptor 54. Upstanding fins 50 on the filter screen 55 engage the underside of the case 46 and cooperate with the lower fins 56 thereon to maintain the case 46 and filter screen 55 in predetermined spaced relation.

An inlet control valve 57 is provided for closing the lower water inlet 22 unless the pressure of water supplied thereto via the riser 26 exceeds a predetermined threshold pressure level thereby protecting against water drainage through sprinklers located at relatively low elevational positions within an irrigation system. As shown in the exemplary drawings, this control valve 57 comprises a disk-shaped head carrying an annular seal ring 60 or the like of a selected resilient material for normal seated engagement onto a valve seat 61 to close the water inlet 22. A stem 59 extends upwardly from the valve head through a central passage in the valve receptor 54 and terminates in an upper end of enlarged barbed shape or the like for snap-fit reception through the receptor 54. This upper end of the stem 59 is seated in turn within a central depression 63 of a pressure reduction valve 64 which carries a circumferential ring 65 slidably within the reduction wall 53. A biasing spring 66 reacts against the underside of an overlying cylinder head 67 of the piston drive assembly 18 to urge the reduction valve 64 downwardly against the stem 59 of the control valve 57, thereby also urging the control valve toward a position closing the lower water inlet 22.

In operation, when water under pressure is supplied to the water inlet fitting 24 at a minimum threshold pressure, the water under pressure urges the control valve 57 upwardly from the inlet 22 thereby permitting water inflow into the housing, as viewed in FIG. 5. A relatively small portion of the water inflow passes upwardly at line pressure through the bypass sleeves 51 into communication with one side of the piston drive assembly 18 while the substantial majority of the water inflow displaces the pressure reduction valve 64 upwardly beyond the reduction wall 53 to permit flow into a pressure chamber 69 above the case 46. However, the water pressure within the pressure chamber 69 is pressure-reduced in comparison with the water at line pressure due to the throttling effects of the reduction valve 64, with a predetermined pressure reduction of about 3 to 4 psi below line pressure being contemplated. From the pressure chamber 69, the water at the slightly reduced reference pressure flows further upwardly within the housing 14 into communication with an upper side of the piston drive assembly 18 and also into communication with the spray head 12. Importantly, during operation, the pressure reduction valve 64 retracts slightly against the spring 66 and in a direction away from the stem 59 of the control valve 57 whereby the incoming water flow through the inlet 22 maintains the control valve 57 retracted in an unloaded, out-of-the-way position within the receptor 54 with little or no pressure loss experienced at the inlet 22. The spring 66 thus serves the dual purposes of biasing the inlet control valve 57 and the reduction valve 64.

The piston drive assembly 18 is mounted within the sprinkler housing 14 in stacked relation above the pressure reduction assembly 44. The piston drive assembly is subjected to a preselected pressure differential provided by the portion of the incoming water flow at line pressure and the water at pressure-reduced reference pressure to reciprocate a drive piston back and forth through a linear stroke.

The piston drive assembly 18 comprises a generally cylindrical support housing 70 installed within the central case 34 with an upper enlarged shoulder 70' resting upon an annular seal 71 at the upper end of the central case 34. Internal ribs 72 within the housing cover 36 engage a portion of the shoulder 70' to retain the housing 70 in a seated position with its lowermost end spaced above the pressure reduction assembly 44. An annular array of holes at the lower end of the support housing 70 accommodate snap-fit reception of lock fingers 67' on the cylinder head 67 for secure attachment thereto. When assembled, the cylinder head 67 has meter ports 73 formed therein and seated into the bypass sleeves 51 of the reduction assembly case 46, with an outer concentric reinforcement sleeve 73' being provided to support the bypass sleeves 51. Depending fins 74 on the underside of the cylinder head 67 may also be provided to maintain the desired vertical spacing between the case 46 and the cylinder head 67, and further to restrain the upper end of the spring 66 in the desired position.

The drive piston of the piston drive assembly 18 is formed by a convoluted resilient diaphragm 75 having its outer periphery securely anchored in a suitable manner between the lower end of the support housing 70 and the outer periphery of the cylinder head 67, with a barbed press-fit connection therebetween being shown by way of example in the illustrative drawings. This resilient diaphragm 75 is centrally stiffened by a lower stiffener plate 76 and an upper piston cup 77 having a diametric size for reciprocal motion into and out of the cylinder head 67, as shown in FIGS. 4 and 5. The meter ports 73 admit water into an upper pressure chamber 78 between the diaphragm 75 and the cylinder head 67, whereas circumferential flow ports 79 positioned throughout the support housing 70 admit the majority of water flow at the reduced reference pressure into the upper interior of the sprinkler housing above the drive piston cup 77, as referenced by arrow 80 in FIGS. 4 and 5. Accordingly, the pressure differential is applied across the drive piston resulting in a net upward hydraulic force within the pressure chamber 78 acting to displace the drive piston upwardly against a piston spring 81 reacting compressively between the upper end of the cup 77 and an invardly radiating lip 82 on the support housing 70.

Figure 6:
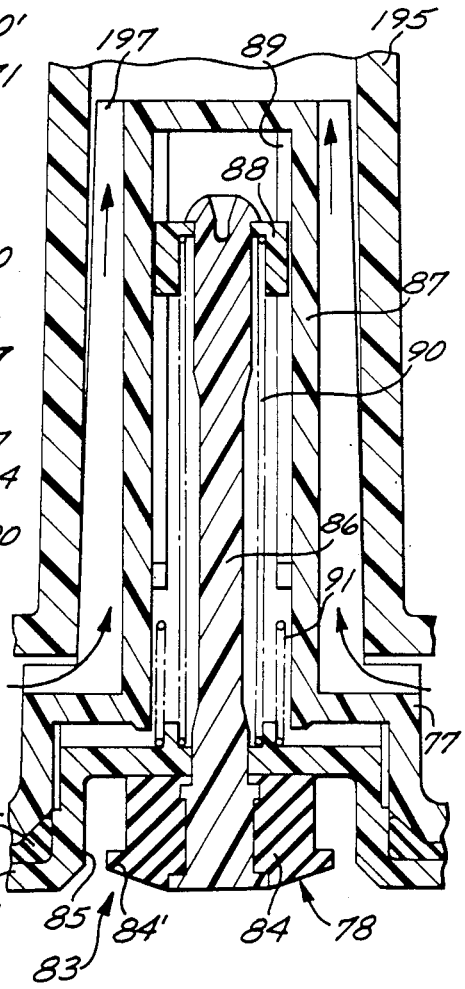
FIG. 6 is an enlarged fragmented vertical sectional view taken generally on the line 6—6 of FIG. 5.
Figure 7:
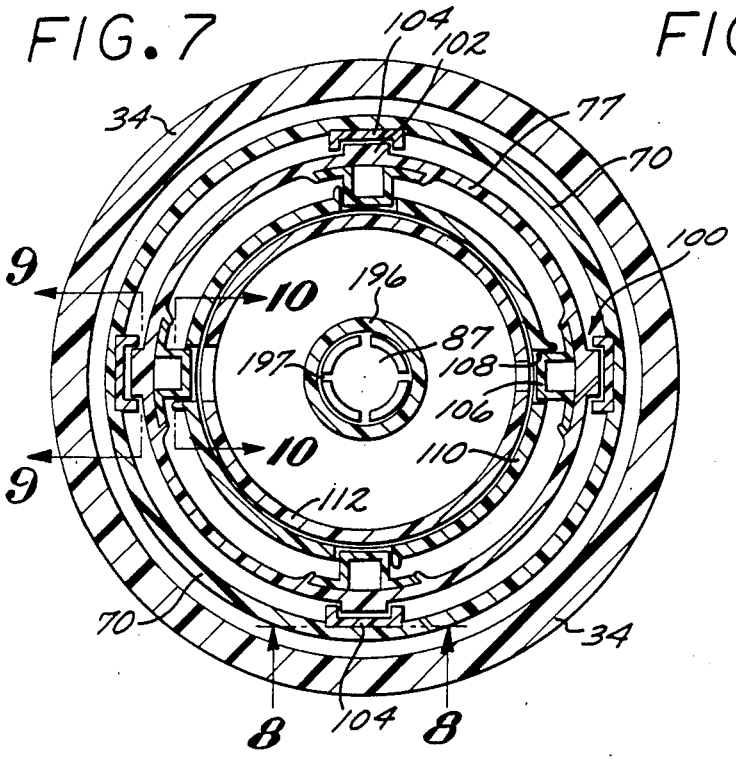
FIG. 7 is a horizontal sectional view taken generally on the line 7—7 of FIG. 5.
Figure 8:
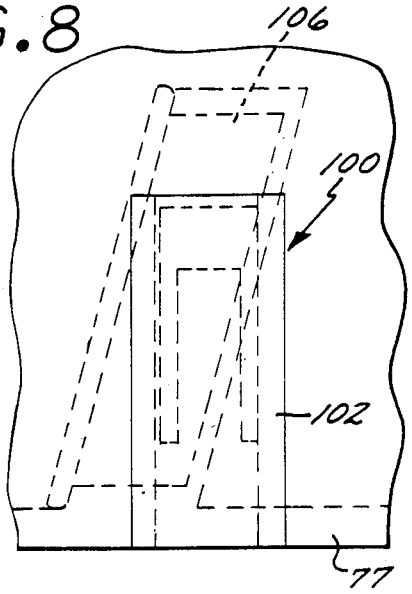
FIG. 8 is an enlarged fragmented vertical sectional view taken generally on the line 8—8 of FIG. 7.
Figure 9:
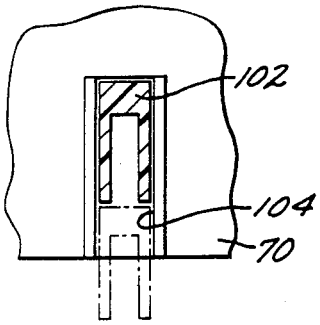
FIG. 9 is an enlarged fragmented vertical sectional view taken generally on the line 9—9 of FIG. 7.

When the drive piston is displaced upwardly through a predetermined stroke, a relief valve assembly 83 operates to relieve the pressure differential across the drive piston thereby permitting return displacement of the drive piston through a reverse stroke to its initial position under the influence of the piston spring 81. More specifically, as shown in FIGS. 5 and 6, the relief valve assembly 83 comprises a poppet valve 84 disposed within the pressure chamber 78 normally within a downwardly open depression 85 in the stiffener plate 76. A poppet stem 86 extends through the plate 76 and upwardly into a central guideway 87 formed integrally with the piston cup 77. An upper end of the stem 86 is barbed or the like for snap-fit reception through a guide ring 88 which is slidably received into the guideway 87 for sliding movement along internal ribs 89. A first compression spring 90 reacts between the underside of the guide ring 88 and the stiffener plate 76 and a second compression spring 91 rides loosely between the stiffener plate 76 and the axially lower end of the ribs 89, wherein these springs 90 and 91 apply spring forces to the poppet stem 86 to operate the poppet valve 84, as will be described.

When water at line pressure is supplied into the upper pressure chamber 78, the water pressure applies a downward hydraulic force to an enlarged peripheral flange 84' on the poppet valve 84. Accordingly, during initial upward travel of the drive piston, the water pressure in the pressure chamber 78 maintains the poppet valve 84 in a position closing an underlying relief port 92 (FIGS. 4 and 5) which leads through the cylinder head 67 into the lower pressure chamber 69. During this initial upward movement of the drive piston, the stiffener plate 76 and piston cup 77 displace upwardly from the poppet valve 84 thereby initially compressing the first spring 90 to increase progressively the upward spring force applied to the poppet valve 84. The upward travel of the piston cup 77 eventually displaces the second spring 91 into engagement with the guide ring 88 whereupon further upward piston cup motion results in compression of the second spring 91. This creates a significant step increase in spring force applied to the valve stem 86 to overcome the downward acting hydraulic forces on the flange 84' thereby rapidly lifting or unseating the poppet valve 84 from the relief port 92. Importantly, the provision of the second spring 91 insures reliable lift-off of the valve 84 at the same stroke length of piston cup motion during each operating cycle.

The open poppet valve 84 relieves the water at line pressure from the pressure chamber 78 into the underlying pressure chamber 69 at reduced reference pressure. During this open relief valve condition, the meter ports 73 in the cylinder head act as orifices to provide sufficient pressure drop as the water flows into the upper chamber 78 to insure the substantial elimination of fluid pressure differential across the drive piston. When this occurs, the piston spring 81 returns the drive piston through a downward stroke to its initial position while simultaneously returning the poppet valve 84 to a position closing the relief port 92. Accordingly, line pressure again builds within the pressure chamber 78 and the drive piston returns through an upward stroke until the poppet valve is again lifted from the relief port 92. Conveniently, full opening of the poppet valve 84 without hang-up is assured by providing flow instabilities arising from an upward jet flow of water through a port 68 in the reduction valve 64 to act upwardly upon the poppet valve 84. Moreover, smooth poppet valve operation is enhanced by providing the stem 86 with a reduced diameter centered region to prevent binding within the stiffener plate 76.

Figure 10:
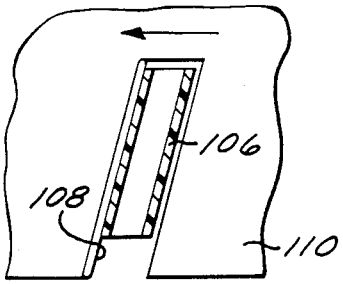
FIG. 10 is an enlarged fragmented vertical sectional view taken generally on the line 10—10 of FIG. 7.

The reciprocatory motion of the drive piston is converted to an oscillating rotary motion by means of a motion converter assembly 100. This motion converter assembly 100 is shown best in FIGS. 4, 5, and 7–10. More particularly, the motion converter assembly comprises a plurality of outer vertically extending guide shoes 102 formed or otherwise suitably mounted on the upper outer periphery of the piston cup 77 and slidingly received into mating vertical guide channels 104 on the support housing 70. These vertical guide shoes are associated with internally mounted and angularly oriented guide ramps 106 on the inner diameter of the piston cup 77. These angled guide ramps 106 are slidably received into guide tracks 108 of mating angular shape formed generally at the lower end of a drive cylinder 110, as shown best in FIG. 10. Accordingly, the vertical linear reciprocation of the piston cup 77 is coupled by the guide ramps 106 and the guide tracks 108 to the drive cylinder 110 to rotate the drive cylinder in an oscillatory manner. An upper bearing ring 111 conveniently supports the drive cylinder 110 for relatively smooth oscillatory rotation within the support housing 70.

The drive cylinder 110 is coupled to an inner driven cylinder 112 by a reversible one-way clutch assembly 114 to provide unidirectional rotational driving of the driven cylinder 112 in a stepwise manner. The clutch assembly 114 is reversible upon reaching selected end limits of an arcuate rotational path to accommodate reversible stepwise driving of the driven cylinder 112 within the range of the selected arcuate path. Alternately, the clutch assembly can be set for stepwise driving of the driven cylinder through continuous full-circle rotation in either direction. In either event, the driven cylinder 112 is linked in turn to a pop-up stem assembly 116 carrying the sprinkler spray head 12 for correspondingly driving the spray head in a stepwise manner.

Figure 21:
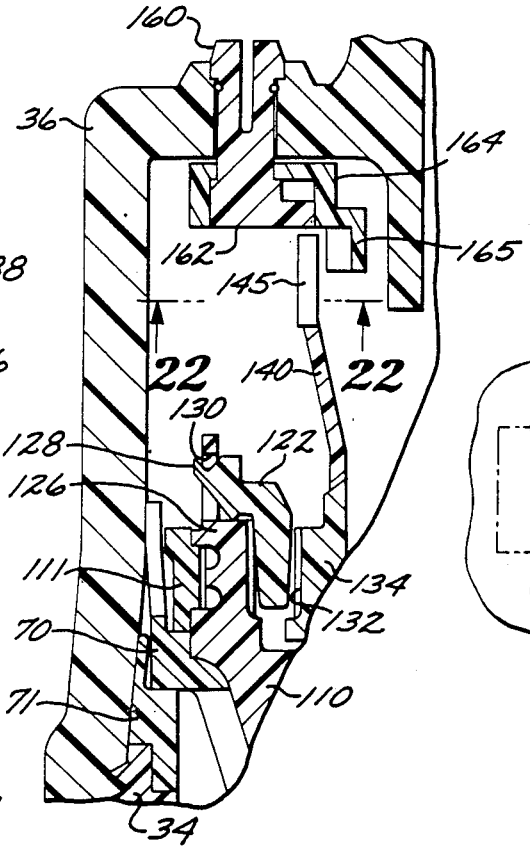
FIG. 21 is an enlarged fragmented vertical sectional view taken generally on the line 21—21 of FIG. 3.

More specifically, as shown in FIGS. 4, 5, and 11–13, the inner driven cylinder 112 is seated within the outer drive cylinder 110 and is driven by means of the clutch assembly which preferably comprises a so-called sprag clutch having a plurality of sprag rollers 118. These sprag rollers 118, six of which are depicted by way of example in FIGS. 12 and 13, comprise short upright cylinders of stainless steel or other selected metal or the like having longitudinally extending outer serrations or knurling (FIGS. 4 and 5). The rollers 118 are individually carried in radially open pockets 120 of a cage ring 122 seated upon an axially presented land 124 at the upper end of the drive cylinder 110. The cage ring 122 positions the sprag rollers 118 within shallow depressions 125 in an upstanding annular retainer 126 of the drive cylinder 110, wherein these depressions 125 are defined by a pair of generally V-shaped walls preferably meeting at a hollowed cut-out. Outwardly projecting tabs 128 (FIGS. 4 and 21) on the cage ring 122 are lockingly received into arcuately elongated lock channels 130 on the drive cylinder 110 to retain the cage ring 122 in position, yet accommodate partial rotational movement of the cage ring within the annular retainer 126.

Figure 12:
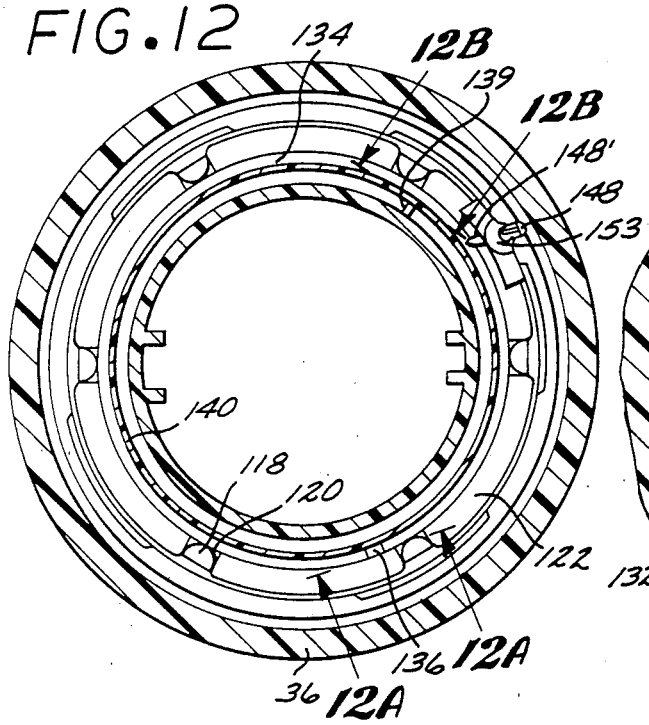
FIG. 12 is a horizontal sectional view taken generally on the line 12—12 of FIG. 5.
Figure 12A:
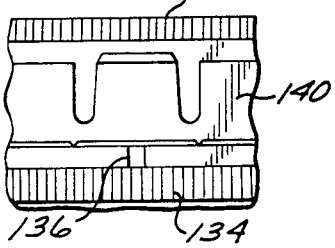
FIG. 12*a* is an enlarged fragmented and somewhat developed vertical sectional view taken generally on the line 12*a*—12*a* of FIG. 12.

The cage ring 122 and the annular retainer 126 of the drive cylinder 110 orient the sprag rollers 118 for binding engagement between one of the angled walls of each depression 125 and a knurled bearing track 132 formed on an annular sprag bearing 134 mounted about the driven cylinder 112 near the upper end thereof. This sprag bearing 134 includes a short upstanding trip dog 136 (FIG. 12*a*) at a selected circumferential position thereon which is predetermined relative to the driven cylinder 112 by forming the sprag bearing 134 with small protrusions 137 and 138 of mismatched size (FIG. 13) for mating fit into corresponding indentations near the upper end of the driven cylinder 112.

Figure 23:
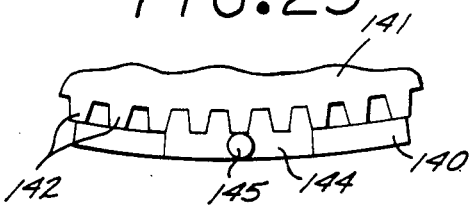
FIG. 23 is an enlarged fragmented horizontal sectional view corresponding with the encircled region 23 of FIG. 11 and illustrating one of a pair of trip dogs in a locked position.
Figure 24:
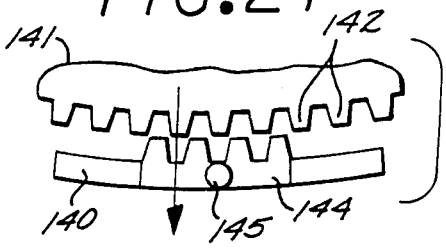
FIG. 24 is an enlarged fragmented horizontal sectional view similar to FIG. 23 but illustrating the trip dog in an unlocked position.
Figure 11:
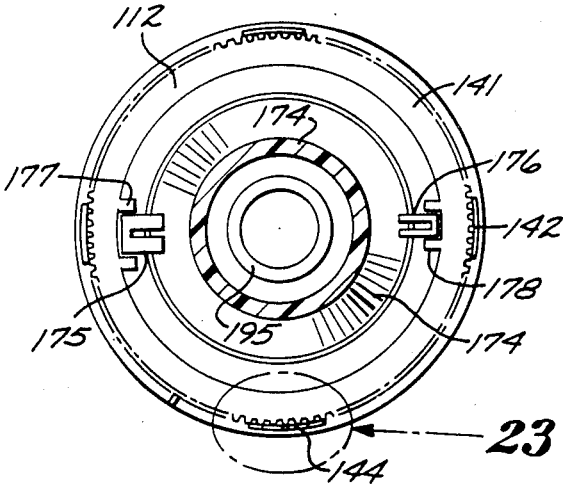
FIG. 11 is a fragmented horizontal sectional view taken generally on the line 11—11 of FIG. 5.
Figure 13:
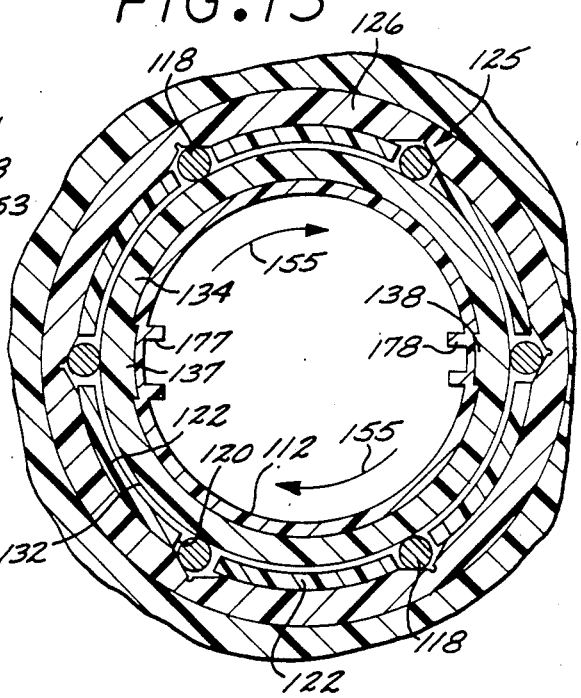
FIG. 13 is a horizontal sectional view taken generally on the line 13—13 of FIG. 5.
Figure 12B:
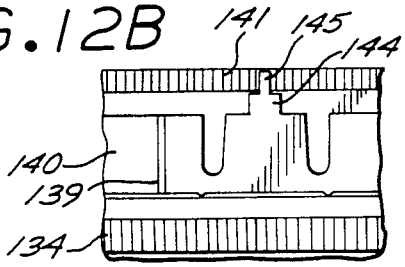
FIG. 12*b* is an enlarged fragmented and somewhat developed vertical sectional view taken generally on the line 12*b*—12*b* of FIG. 12.
Figure 14:
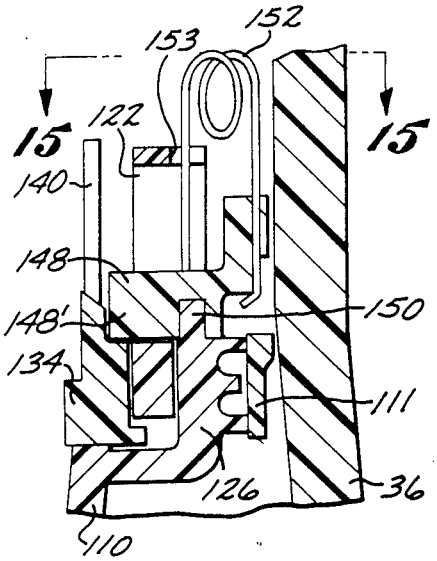
FIG. 14 is an enlarged fragmented vertical sectional view taken generally on the line 14—14 of FIG. 3.

A second trip dog 139 (FIG. 12*b*) is provided in the form of a radially outwardly projecting flange on a trip ring 140. This trip ring 140 is adjustably or rotatably carried about the driven cylinder 112 in a position above the sprag bearing 134 and axially below an upper cylinder rim 141 defining a circumferential array of gear teeth 142. These gear teeth provide means for releasably locking the trip ring 140 against rotation by engagement with a pawl 144 on the trip ring 140, as depicted in FIGS. 11, 23, and 24, wherein the pawl is spring-loaded as by use of a resilient material for normal engagement with the gear teeth. An adjustment peg 145 projects upwardly from the pawl 144 and upwardly beyond the driven cylinder 112 for use in adjusting the rotational position of the second trip dog 139, as will be described in more detail.

The direction of rotational driving connection between the oscillating drive cylinder 110 and the inner driven cylinder 112 is controlled by a spring-loaded reversing mechanism including a trip lever 148 mounted on a pivot post 150 on the upper end of the drive cylinder 110. An over-center trip spring 152 has one leg anchored within a socket on the trip lever 148 and the second leg carried relatively loosely with some freedom of lateral motion within a circumferentially or arcuately enlarged notch 153 on the cage ring 122. The notch 153 accommodates over-center motion of the trip spring 152 between two alternate positions, as viewed in FIGS. 15 and 16 to correspondingly shift the trip lever 148 between forward and reverse drive positions. Importantly, as the trip spring 152 moves over-center, the loosely anchored leg snaps from one side of the arcuate notch 153 to the other to apply an impact force upon the cage ring 122 assisting in positive positional shifting thereof.

Figure 15:
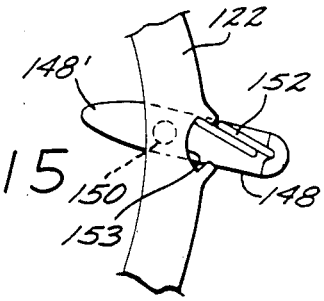
FIG. 15 is an enlarged framgented horizontal sectional view taken generally on the line 15—15 of FIG. 14 and illustrating a reversing trip mechanism in a forward drive position.

When the trip lever 148 is in a first or forward drive position, as viewed in FIG. 15, the trip spring 152 urges the cage ring 122 in one rotational direction to shift each of the sprag rollers 118 toward binding contact with one of the associated angled walls of the depressions 125 in the retainer 126. In this position, the rollers bind between the depression walls and the bearing track 132 upon drive cylinder rotation in one direction to correspondingly drive the inner sprag cylinder 112 in the same direction, as depicted by arrows 155 in FIG. 13. However, reverse drive cylinder rotation is accommodated by rolling displacement of the individual sprag rollers 118 to permit the drive cylinder 110 to override or free-wheel through a short stroke relative to the driven cylinder 112. Accordingly, driven cylinder rotation is unidirectional in the direction of arrows 155 (FIG. 13) and in a series of regular small rotational steps.

Figure 16:
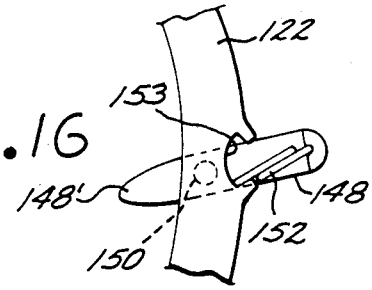
FIG. 16 is a fragmented horizontal sectional view similar to FIG. 15 but illustrating the reversing trip mechanism in a reverse drive position.

The trip lever 148, when shifted to the alternate position, as viewed in FIG. 16, switches the cage ring 122 to carry the rollers 118 toward binding engagement with the other depression-forming walls, as viewed in FIGS.

Figure 17:
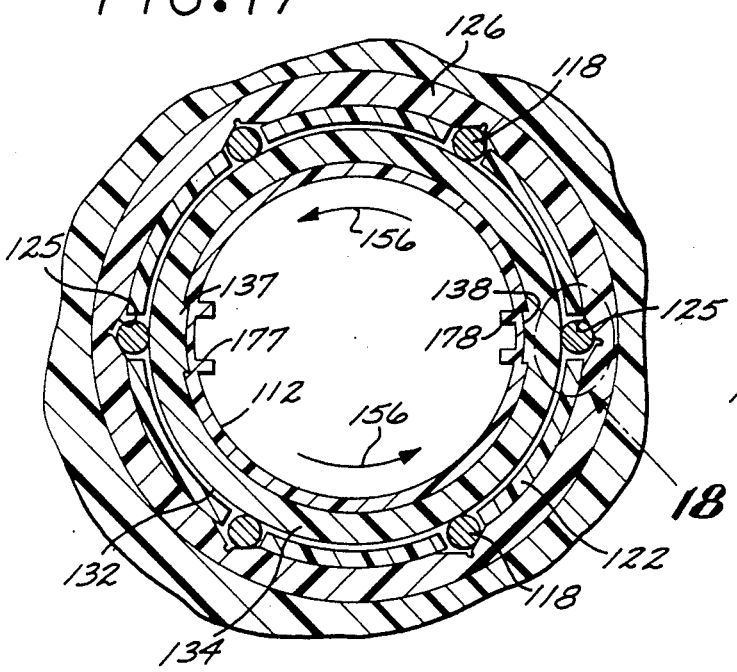
FIG. 17 is a horizontal sectional view similar to FIG. 13 but illustrating the sprinkler in a reverse drive position.
Figure 18:
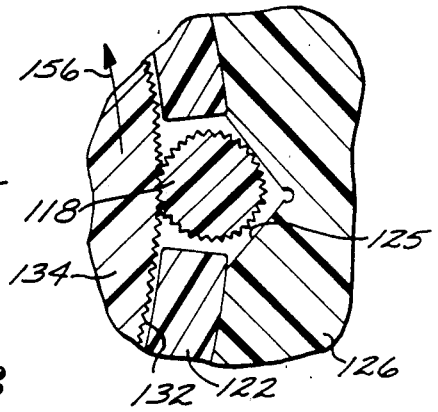
FIG. 18 is an enlarged fragmented sectional view generally corresponding with the encircled region 18 of FIG. 17.

17 and 18. In this position, the driving engagement between the drive and driven cylinders 110 and 112 is in an opposite rotational direction, as depicted by arrows 156 (FIGS. 17 and 18), with free-wheeling occurring upon drive cylinder rotation in a direction opposite the arrows 156. Accordingly, driven cylinder rotation occurs again in a series of unidirectional stepwise movements but in a reverse direction to that depicted in FIG. 13.

Figure 22:
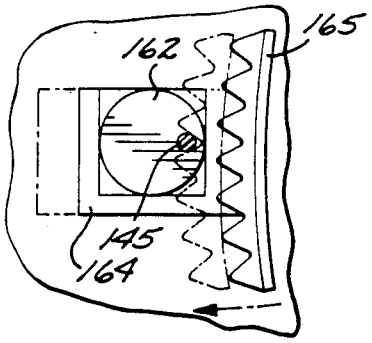
FIG. 22 is an enlarged fragmented horizontal sectional view taken generally on the line 22—22 of FIG. 21.

The trip dogs 136 and 139 respectively on the sprag bearing 134 and the upper trip ring 140 function to switch the position of the trip lever 148 automatically in response to driven cylinder rotational position. More particularly, the trip lever 148 includes a radially inwardly projecting toe 148' (FIGS. 12 and 14–16) extending into a position for engagement by the trip dogs 136 and 139 as they are rotated toward contact with the toe along by the driven cylinder 112. These trip dogs thus define the left- and right-hand end limits of a part-circle rotational path of motion for causing driven cylinder rotation reversibly in a stepwise manner within an arcuate path. Conveniently, the second or right-hand trip dog 139 can be adjusted in rotational position relative to the driven cylinder 112 and thus also relative to the first trip dog 136 by means of an adjustment screw 160 exposed on the exterior of the sprinkler housing cover 36. This adjustment screw, as shown best in FIGS. 21–24, is coupled to a cam lobe 162 within the sprinkler housing for shifting an actuator 164 between a normal or locked position (FIGS. 21–23) which does not interfere with the upstanding adjustment peg 145 on the trip ring 140 and an adjust position as depicted in FIGS. 22 (dotted lines) and 24 for carrying a rack 165 in a direction for disconnecting the pawl 144 from the gear teeth 142 and thereby permit relative rotation of the driven cylinder 112 to adjust the position of the second trip dog 139. In the normal position, however, the pawl 144 retains the trip ring 140 locked against rotational slipping during sprinkler operation. Indicia (FIG. 3) on the sprinkler housing may be provided to indicate the position of the adjustment screw.

The pop-up stem assembly 116 is carried within the driven cylinder 112 for unidirectional yet reversible stepwise rotational driving along with the driven cylinder 112. As shown best in FIGS. 4 and 5, the pop-up stem assembly 116 comprises an outer stem 172 of hollow configuration and having an enlarged lower shoulder 172' for seating of a retraction spring 170 acting between the shoulder 172' and a wiper seal 168 lining the central opening 37 within the housing cover 36. An inner hollow stem 174 is rotatably received within the outer stem 172 and includes an enlarged shoulder below the outer stem with guide tabs 175 and 176 of mismatched size for sliding reception into mating tracks 177 and 178 within the driven cylinder 112. Accordingly, rotational driving of the driven cylinder 112 is couples directly via the tabs 175 and 176 to the inner stem 174 to drive the inner stem in a similar manner. The retraction spring 170 normally maintains the entire pop-up assembly 116 in a retracted position substantially within the sprinkler housing when the sprinkler is not in use (FIG. 4) but accommodates pressure-activated elevation of the inner and outer stem to an elevated spraying position, as viewed in FIG. 5, in response to supply of water under pressure into the housing interior. The wiper seal 168 advantageously includes an upper resilient grit wiper 169 projecting upwardly and inwardly to wipe sand particles and the like from the stem upon stem retraction, in combination with a pair of inwardly and trio of inwardly and downwardly protruding resilient lips 168' for providing improved sealing against leakage upon supply of water to the housing interior. Moreover, washer seals 179 are provided between complementary shoulders of the inner and outer stems 174 and 172 to seal against leakage therebetween yet permit rotation of the inner stem. Still further, the stem 174 advantageously includes axially spaced groups of bearing rings 171 which prevent off-center rotation between the inner and outer stems 174 and 172, wherein these bearing rings 171 are preferably formed eccentrically to a vertical axis of the outer stem. The direction of eccentricity is chosen to shift the inner stem 174 off-center by a small amount (about 0.01 inch) to compensate for reaction forces applied to the stem 174 by the outwardly projected water stream which urges the stem to a substantially vertical position during operation.

Figure 19:
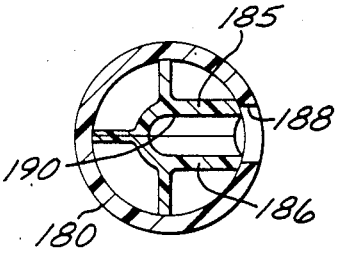
FIG. 19 is a horizontal sectional view taken generally on the line 19—19 of FIG. 5.
Figure 20:
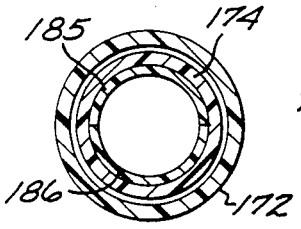
FIG. 20 is a horizontal sectional view taken generally on the line 20—20 of FIG. 5.

The spray head 12 is mounted at the upper end of the inner stem 174. This spray head 12, as shown best in FIGS. 4, 5, 19, and 20 comprises a downwardly open cylindrical housing 180 having an upper keyway 182 for seated reception of keys at the upper ends of complementary-shaped nozzle halves 185 and 186 (FIGS. 19 and 20). These nozzle halves are formed preferably from lightweight molded plastic or the like and protrude together a short distance into the upper end of the inner stem 174 when the nozzle housing 180 is threadably mounted thereonto, with an additional seal 187 being conveniently provided between the nozzle housing 180 and the outer stem 172 and sized to be bridged by the lips 168'. Importantly, the threaded connection between the inner stem 174 and the nozzle housing 180 comprises a timed thread to insure rotational movement of the housing 180 to a fixed rotational position thereby placing a discharge outlet 188 in the housing in a predetermined rotational position relative to the left-hand trip dog 136 on the driven cylinder 112 by virtue of the fixed rotational relationship between the inner stem 74 and the driven cylinder. In addition, a stream splitter screw 189 may be provided in the spray head to project downwardly a selected distance into the water stream for controlled interruption thereof, if desired, and a co-molded resilient cap 181 is located on the top of the housing 180 to protect the spray head along with the resilient head 40.

The nozzle halves 185 and 186 cooperatively define an improved nozzle configuration having an internal vaneless flow path 190 shaped for improved stream range and overall stream distribution. More particularly, with reference to FIGS. 4 and 5, the flow path 190 is shaped to converge progressively throughout its length for constant acceleration from a lower end of the nozzle halves and to extend with a centerline offset in a direction away from stream projection. The flow path then turns through an upper curve and a straight region 191 before a nozzle outlet orifice through which the water is projected laterally upwardly and outwardly as the primary irrigation stream 16. This offset or backset of the nozzle flow path advantageously permits increase in the length of the straight section 191 before the orifice discharge which has been found to increase stream range. A smaller secondary nozzle outlet 192 below the primary orifice is also provided to yield a smaller, secondary irrigation stream for improved close-in watering distribution.

In accordance with a further feature of the invention, water flowing upwardly through the sprinkler housing 14 for discharge passage through the pop-up stem assembly 116 and spray head 12 is directed in part in a turbulent fashion through the piston cup 77 to prevent accumulation of dirt and grit therein which might otherwise interfere with proper reciprocatory motion of the drive piston and oscillatory motion of the drive cylinder 110. More particularly, as shown best in FIGS. 4 and 5, the support housing 70 and the piston cup 77 respectively include annular arrays of water flow openings 79 and 193 to permit water flow into the lower region of the piston cup. This water flow continues into communication with an upright vacuum stem 195 having an enlarged base 196 with feet shaped for snap-fit reception or the like into the piston cup and an upper cylindrical riser extending about and above the relief valve assembly 83. Ribs 197 on the exterior of the guideway 87 define a flow path through which this water flow is effectively pumped upwardly within the vacuum stem 195 to provide a vacuuming or suctioning action within the piston cup 77 and over the diaphragm convolutions to prevent accumulation of dirt or debris within or upon the diaphragm. This vacuuming or suctioning action is enhanced by positioning the upper end of the vacuum stem for partial displacement into and out of the elevated inner stem 174, as shown in FIG. 5, when the inner stem is in the elevated position.

Accordingly, in operation, the control valve 57 (FIGS. 4 and 5) prevents water inflow to the housing 14 until the pressure thereof exceeds a minimum threshold according to the size of the valve 57 and the design of the biasing spring 66. When this threshold pressure is reached, the pressure reduction assembly 44 reacts to incoming water flow to apply a controlled pressure differential across the drive piston of the piston drive assembly 18. This pressure differential coacts with the relief valve assembly 83 and the piston spring 81 to reciprocate the drive piston at a controlled rate, which reciprocation is converted to oscillatory rotation of the drive cylinder 110. This oscillatory motion is coupled through the clutch assembly 114 to drive the driven cylinder 112 unidirectionally in a stepwise manner, with the driven cylinder being coupled to the pop-up stem assembly 116 carrying the spray head 12. The direction of driving is reversed by shifting the position of the trip lever 148 (FIGS. 14–16), for example, by means of the trip dogs 136 and 139 to achieve reversible part-circle rotation of the spray head. Alternately, full-circle rotation can be obtained in either direction by omitting the trip dogs. Irrespective of the direction of driving, however, the water flows upwardly within the sprinkler housing and through the inner stem 174 to the spray head 12 for outward projection therefrom as the irrigation water stream 16 (FIG. 2).

The improved rotary drive sprinkler of the present invention thus provides an effective and highly reliable piston drive apparatus for rotating a sprinkler spray head through an incremental stepwise motion. The rotational stepping rate is substantially independent of line pressure supplied to the sprinkler but is instead governed by an internally created pressure differential of relatively constant magnitude. Drive components are subjected to relatively slow, controlled drive movement to minimize wear and thereby reduce maintenance requirements for the sprinkler, and further to permit the substantial majority of the components to be constructed from a lightweight plastic, if desired. Moreover, water-entrained dirt and grit and other debris is effectively prevented from accumulating within the sprinkler where it might otherwise interfere with mechanical operation.

A variety of modifications and improvements to the improved rotary drive sprinkler of the present invention are believed to be apparent to those skilled in the art. Accordingly, no limitation is intended by way of the description and drawings herein, except as set forth in the appended claims.

What is claimed is:

1. A rotary drive sprinkler comprising:

a sprinkler housing having a lower water inlet for inflow of water from a water supply at line pressure into said housing;

a pressure reduction assembly including means for dividing water inflow into said housing into a first flow portion substantially at line pressure and a second flow portion, and a reduction valve for reducing the pressure of said second flow portion to a predetermined reference pressure;

a piston drive assembly including a reciprocal drive piston and a piston spring for urging said drive piston in one direction, said piston drive assembly further including means for applying said first and second flow portions to opposite sides of said drive piston thereby subjecting said drive piston to a pressure differential to displace said drive piston in a second direction against said piston spring, and relief valve means for relieving the pressure differential across said drive piston at the end of a predetermined stroke in said second direction to permit said piston spring to return said drive piston through said stroke in said one direction;

a drive element rotatably supported within said housing;

motion conversion means coupled between said drive piston and said drive element for rotatably oscillating said drive element in response to reciprocation of said drive piston;

a driven element rotatably supported within said drive element;

a reversible one-way clutch assembly coupled between said drive and driven elements for rotatably driving said driven element in a selected direction in small rotational steps in response to oscillatory rotation of said drive element;

a pop-up stem assembly supported within said housing for movement between a normal retracted position substantially within said housing to an elevated spraying position with an upper end thereof elevated above said housing upon supply of water into said housing through said inlet, said stem assembly being rotatably driven by said driven element; and a spray head on said stem assembly and including a spray nozzle for outward projection of an irrigation water stream from said housing.

2. The rotary drive sprinkler of claim 1 further including an inlet control valve for preventing water flow into said housing through said inlet unless the pressure thereof is at a predetermined threshold pressure.

3. The rotary drive sprinkler of claim 1 wherein said pressure reduction assembly comprises a case having bypass openings therein to permit flow of said first flow portion into communication with one side of said driven piston, said pressure reduction assembly case defining an open port and a biasing spring normally urging said reduction valve to close said port, said reduction valve permitting said second flow portion to flow through said port at said reduced reference pressure into communication with the opposite side of said drive piston.

4. The rotary drive sprinkler of claim 3 further including an inlet control valve for preventing water flow into said housing through said inlet unless the pressure thereof is at a predetermined threshold pressure, said reduction valve being urged by said biasing spring to bear against said control valve when said control valve closes said inlet, said reduction valve being retractable from said control valve when said control valve is in an open position relative to said inlet.

5. The rotary drive sprinkler of claim 4 wherein said case includes a receptor member for seated reception of said control valve when said control valve is in said open position.

6. The rotary drive sprinkler of claim 5 wherein said control valve includes a stem extending away from said inlet and through said receptor member for slidable connection to said reduction valve.

7. The rotary drive sprinkler of claim 3 wherein said case is shaped to define a pressure chamber on the side of said reduction valve opposite said inlet.

8. The rotary drive sprinkler of claim 1 wherein said reduced reference pressure is on the order of three to four psi below said line pressure.

9. The rotary drive sprinkler of claim 1 wherein said piston drive assembly comprises a cylinder head mounted within said housing, said drive piston being reciprocally mounted on said cylinder head and cooperating therewith to define a pressure chamber, at least one meter port for passage of said first flow portion into said pressure chamber, and means for communicating said second flow portion with the side of said drive piston opposite said pressure chamber.

10. The rotary drive sprinkler of claim 9 wherein said piston spring biases said drive piston for displacement in a direction reducing the volume of said pressure chamber, said first and second flow portions applying said pressure differential across said drive piston to move said drive piston in an opposite direction expanding the volume of said drive piston.

11. The rotary drive sprinkler of claim 10 further including means for restricting said drive piston to a generally linear reciprocation within said housing.

12. The rotary drive sprinkler of claim 10 wherein said relief valve means comprises a relief valve for controllably opening and closing a relief port formed in said cylinder head, and spring means for urging said relief valve toward an open position, said relief valve including an enlarged flange subjected to line pressure within said pressure chamber for maintaining said relief valve in a closed position throughout movement of said drive piston in a direction expanding said pressure chamber, said drive piston cooperating with said spring means to increase the force applied to urge said relief valve to the open position throughout said expanding drive piston movement thereby opening said relief valve to relieve the line pressure within said pressure chamber and permitting said piston spring to return said drive piston through a reverse stroke.

13. The rotary drive sprinkler of claim 12 wherein said spring means comprises a pair of springs for urging said relief valve toward said open position.

14. The rotary drive sprinkler of claim 12 wherein said spring means comprises a first spring for urging said relief valve toward said open position throughout expanding drive piston movement and a second spring for supplementing said first spring throughout a latter portion of the expanding drive piston movement.

15. The rotary drive sprinkler of claim 9 wherein said drive piston comprises a resilient diaphragm.

16. The rotary drive sprinkler of claim 1 wherein said motion conversion means comprises at least one angularly oriented guide ramp and mating guide channel on said drive piston and said drive element for rotating said drive element in an oscillatory motion in response to drive piston reciprocation.

17. The rotary drive sprinkler of claim 1 wherein said clutch assembly comprises a sprag clutch.

18. The rotary drive sprinkler of claim 1 wherein said clutch assembly is reversible between a forward drive position and a reverse drive position for respectively driving said driven element in steps in forward and reverse rotational directions.

19. The rotary drive sprinkler of claim 18 further including a reverse mechanism for reversing the setting of said clutch assembly between said forward and reverse drive positions.

20. The rotary drive sprinkler of claim 19 wherein said reverse mechanism includes a trip lever movable between first and second positions to switch said clutch assembly between said forward and reverse drive positions and over-center spring means for maintaining said trip lever in a selected one of said first and second positions, said spring means having a pair of legs respectively anchored by said drive element and said clutch assembly, one of said drive element and said clutch assembly including an enlarged notch for loosely anchoring the associated leg.

21. The rotary drive sprinkler of claim 20 including a pair of trip dogs on said driven element for reversibly switching the position of said trip lever for rotatable driving of said driven element reversibly between end limits of an arcuate path.

22. The rotary drive sprinkler of claim 21 wherein at least one of said trip dogs is adjustable in position relative to said driven element and the other of said trip dogs.

23. The rotary drive sprinkler of claim 22 including means for releasably locking said one trip dog against adjustment.

24. The rotary drive sprinkler of claim 23 including adjustment means accessible from the exterior of said housing for unlocking said one trip dog to permit adjustment thereof.

25. The rotary drive sprinkler of claim 1 wherein said spray head has a co-molded resilient protective cap at the upper end thereof.

26. The rotary drive sprinkler of claim 1 including means for mounting said spray head onto said stem assembly with said spray nozzle oriented in a predetermined rotational position relative to said stem assembly.

27. The rotary drive sprinkler of claim 1 wherein said spray nozzle defines a water flow path of generally upwardly converging geometry and extending angularly to a position offset relative to a centerline axis of said pop-up stem assembly and then curving to a relatively straight discharge section terminating in a discharge orifice through which the water is projected outwardly as the irrigation water stream.

28. The rotary drive sprinkler of claim 27 further including a secondary discharge outlet below said straight discharge section.

29. The rotary drive sprinkler of claim 27 wherein said spray nozzle is formed from a mating pair of nozzle halves, said spray head including means for supporting said nozzle halves relative to each other to form said water flow path through said nozzle.

30. The rotary drive sprinkler of claim 1 further including a hollow vacuum stem carried by said driven piston and extending upwardly therefrom to a position generally at the lower end of said pop-up stem assembly when said stem assembly is in the elevated spraying position, said vacuum stem being movable with said drive piston to induce an upward water flow preventing accumulation of grit and the like on said drive piston.

31. The rotary drive sprinkler of claim 1 wherein said housing is formed from plastic and includes an inlet fitting adjacent said inlet, said inlet fitting including generally concentric, interconnected fitting walls.

32. The rotary drive sprinkler of claim 1 wherein said housing includes an upper opening for movement of said pop-up stem assembly between the retracted and elevated spraying positions, and further including a wiper seal lining said upper opening and having an upper grit wiper extending inwardly and upwardly and at least two seal lips extending inwardly and downwardly in spaced relation below said grit wiper.

33. The rotary drive sprinkler of claim 1 wherein said housing includes a cover of plastic material, and further including a hood for said cover, said hood being formed from a resilient material co-molded onto a skeletal plastic frame with at least some of said frame exposed for adhesive attachment to said cover.

34. The rotary drive sprinkler of claim 1 wherein said pop-up stem assembly includes a pop-up stem carrying said spray head and bearing means for supporting said stem for sliding movement between said retracted and elevated positions, said bearing means being eccentric with respect to a central axis of the pop-up stem assembly to offset reaction forces due to the outwardly projected water stream.

35. A rotary drive sprinkler, comprising:

a sprinkler housing having a water flow inlet;

a piston drive assembly within said housing and including a reciprocal drive piston and means for reciprocating said drive piston in response to water flow into said housing through said inlet, said reciprocating means including means for dividing at least part of water inflow into said housing into first and second flow portions at a substantially constant selected pressure differential which is substantially independent of the pressure of water supplied to said housing, spring means for urging said drive piston through a stroke in one direction, means for applying said selected pressure differential across said drive piston for urging said drive piston through a stroke in the opposite direction, and means for alternately applying and relieving said selected pressure differential across said drive piston;

a motion converter assembly for converting reciprocating motion of said drive piston to oscillatory rotary motion;

a spray head rotatably supported by said housing and including a nozzle for outward projection of water from said housing; and a one-way clutch assembly coupled between said motion converter assembly and said spray head for rotatably driving said spray head in one rotational direction in a series of small rotational steps.

36. The rotary drive sprinkler of claim 35 wherein said clutch assembly is reversible for rotatable driving of said spray head in either rotational direction.

37. The rotary drive sprinkler of claim 36 including a reverse mechanism for reversing the setting of said clutch assembly.

38. The rotary drive sprinkler of claim 37 wherein said reverse mechanism includes a trip lever movable between first and second positions to switch said clutch assembly between forward and reverse drive positions, and a pair of trip dogs rotatable with said spray head for respectively switching the position of said reverse lever at the opposite end limits of a selected arcuate rotational path.

39. The rotary drive sprinkler of claim 38 including means for adjusting the position of at least one of said trip dogs from the exterior of said housing.

40. A rotary drive sprinkler, comprising:

a sprinkler housing having a water flow inlet;

a piston drive assembly within said housing and including a reciprocal drive piston and means for reciprocating said drive piston in response to water flow into said housing through said inlet;

a motion converter assembly for converting reciprocating motion of said drive piston to rotary motion;

a spray head rotatably supported by said housing and including a nozzle for outward projection of water from said housing;

a one-way clutch assembly coupled between said motion converter assembly and said spray head for rotatably driving said spray head in one rotational direction in a series of small rotational steps; and means for inducing a suctioning water flow across said drive piston to sweep grit therefrom.

41. A rotary drive sprinkler, comprising:

a sprinkler housing having a water flow inlet;

a piston drive assembly within said housing and including a reciprocal drive piston and means for reciprocating said drive piston and means for reciprocating said drive piston in response to water flow into said housing through said inlet;

a motion converter assembly for converting reciprocating motion of said drive piston to rotary motion;

a spray head rotatably supported by said housing and including a nozzle for outward projection of water from said housing; and a one-way clutch assembly coupled between said motion converter assembly and said spray head for rotatably driving said spray head in one rotational direction in a series of small rotational steps;

said nozzle defining a water flow path of generally upwardly converging geometry, said flow path extending laterally in one direction and then curving to a discharge section extending along a relatively straight axis laterally in an opposite direction.

42. The rotary drive sprinkler of claim 41 wherein the nozzle flow path converges progressively throughout its length.

43. A rotary drive sprinkler, comprising:

a sprinkler housing having a water flow inlet;

a spray head rotatably mounted on said sprinkler housing and including a nozzle for outward projection of water from said housing; and water-powered drive means including a reciprocating drive piston for rotatably driving said spray head in steps at a rate of speed substantially independent of the pressure of water supplied to said housing, said drive means including means for dividing at least a portion of water inflow into said housing into first and second flow portions at a substantially constant pressure differential which is substantially independent of the pressure of water supplied to said housing to urge said piston through a stroke in one direction and means for urging said piston through a return stoke in an opposite direction.

44. A rotary drive sprinkler, comprising:

a sprinkler housing having a water flow inlet;

a spray head rotatably mounted on said sprinkler housing and including a nozzle for outward projection of water from said housing;

a reciprocal drive piston within said housing;

means for reciprocating said drive piston at a rate substantially independent of the pressure of water supplied to said housing, said reciprocating means including means for dividing at least a portion of water inflow into said housing into first and second flow portions at a substantially constant pressure differential which is substantially independent of the pressure of water supplied to said housing to urge said piston through a stroke in one direction and means for urging said piston through a return stroke in an opposite direction; and clutch means coupled between said drive piston and said spray head for rotatably driving said spray head in steps in response to reciprocation of said drive piston.

45. A rotary drive sprinkler, comprising:

a sprinkler housing having a water flow inlet;

a spray head rotatably mounted on said sprinkler housing and including a nozzle for outward projection of water from said housing;

a drive cylinder rotatably supported within said housing;

means for rotating said drive cylinder with an oscillatory motion at a rate substantially independent of pressure of water supplied to said housing, said rotating means including means for dividing at least a portion of water inflow into said housing into first and second flow portions at a substantially constant prssure differential which is substantially independent of the pressure of water supplied to said housing to urge said cylinder through a rotary stroke in one direction and means for urging said cylinder through a return rotary stroke in an opposite direction; and clutch means coupled between said drive piston and said spray head for rotatably driving said spray head in steps in response to reciprocation of said drive piston.

46. A rotary drive sprinkler, comprising:

a sprinkler housing having a lower water inlet for inflow of water from a water supply at line pressure into said housing;

a control valve for preventing water flow into said housing unless the line pressure thereof is at least a minimum threshold pressure;

a pressure reduction assembly including means for dividing water inflow into said housing into a first flow portion substantially at line pressure and a second flow portion, and a reduction valve for reducing the pressure of said second flow portion to a predetermined reference pressure;

a piston drive assembly including a reciprocal drive piston and a piston spring for urging said drive piston in one direction, said piston drive assembly further including means for applying said first and second flow portions to opposite sides of said drive piston thereby subjecting said drive piston to a pressure differential to displace said drive piston in a second direction against said piston spring, and relief valve means for relieving the pressure differential across said drive piston at the end of a predetermined stroke in said second direction to permit said piston spring to return said drive piston through said stroke in said one direction;

a drive cylinder rotatably supported within said housing;

motion conversion means coupled between said drive piston and said drive cylinder for rotatably oscillating said drive cylinder in response to reciprocation of said drive piston;

a driven cylinder rotatably supported within said drive cylinder;

a reversible one-way clutch assembly coupled between said drive and driven cylinders for rotatably driving said driven cylinder in a selected direction in small rotational steps in response to oscillatory rotation of said drive cylinder;

a reverse mechanism including a trip lever for reversing the setting of said clutch assembly and a pair of trip dogs rotatable with said driven cylinder for engaging said trip lever to shift the position thereof reversing the setting of said clutch assembly;

a pop-up stem assembly supported within said housing for movement between a normal retracted position substantially within said housing to an elevated spraying position with an upper end thereof elevated above said housing upon supply of water into said housing through said inlet, said stem assembly being rotatably driven by said driven cylinder; and a spray head on said stem assembly and including a spray nozzle for outward projection of an irrigation water stream for said housing.

47. The rotary drive sprinkler of claim 46 wherein said pressure reduction assembly includes a biasing spring for urging said reduction valve against said control valve to bias said control valve toward a position preventing water flow into said housing unless the line pressure thereof is at least a minimum threshold pressure, said control valve having a pressure-exposed surface area less than said reduction valve, said reduction valve retracting from said control valve to unload said biasing spring from said control valve upon line pressure of at least the minumum threshold pressure.

48. The rotary drive sprinkler of claim 47 wherein said pressure reduction assembly includes a stationary receptor for seated reception of said control valve in an out-of-the-way positon upon flow of water into said housing.

49. The rotary drive sprinkler of claim 46 wherein said piston drive assembly comprises a cylinder head mounted within said housing said drive piston being reciprocally mounted on said cylinder head and cooperating therewith to define a pressure chamber, at least one meter port for passage of said first flow portion into said pressure chamber, and means for communicating said second flow portion with the side of said drive piston opposite said pressure chamber.

50. The rotary drive sprinkler of claim 49 wherein said piston spring biases said drive piston for displacement in a direction reducing the volume of said pressure chamber, said first and seond flow portions applying said pressure differential across said drive piston to move said drive piston in an opposite direction expanding the volume of said drive piston.

51. The rotary drive sprinkler of claim 50 wherein said relief valve means comprises a relief valve for controllably opening and closing a relief port formed in said cylinder head, and spring means for urging said relief valve toward an open position, said relief valve including an enlarged flange subjected to line pressure within said pressure chamber for maintaining said relief valve in a closed position throughout movement of said drive piston in a direction expanding said pressure chamber, said drive piston cooperating with said spring means to increase the force applied to urge said relief valve to the open position throughout said expanding drive piston movement therby opening said relief valve to relieve the line pressure within said pressure chamber and permitting said piston spring to return said drive piston through a reverse stroke.

52. The rotary drive sprinkler of claim 51 wherein said spring means comprises a first spring for urging said relief valve toward said open position throughout expanding drive piston movement and a second spring for supplementing said first spring throughout a latter portion of the expanding drive piston movement.

53. The rotary drive sprinkler of claim 46 wherein said motion conversion means comprises at least one angularly oriented guide ramp and mating guide channel on said drive piston and said drive cylinder for rotating said drive cylinder in an oscillatory motion in response to drive piston reciprocation.

54. The rotary drive sprinkler of claim 46 wherein said clutch assembly comprises a sprag clutch.

55. The rotary drive sprinkler of claim 54 wherein said clutch assembly is reversible between a forward drive position and a reverse drive position for respectively driving said driven cylinder in steps in forward and reverse rotational directions.

56. The rotary drive sprinkler of claim 55 wherein said trip lever is movable between first and second positions to switch said clutch assembly between said forward and reverse drive positions, and further including over-center spring means for maintaining said trip lever is a selected one of said first and second positions, said spring means having a pair of legs respectively anchored by said drive cylinder and said clutch assembly, one of said drive cylinder and said clutch assembly including an enlarged notch for loosely anchoring the associated leg.

57. The rotary drive sprinkler of claim 56 wherein said pair of trip dogs on said driven cylinder reversibly switch the position of said trip lever for rotatable driving of said driven cylinder reversibly between end limits of an arcuate path, at least one of said trip dogs being adjustable in position relative to the other of said trip dogs, means for releasably locking said one trip dog against adjustment, and adjustment means accessible from the exterior of said housing for releasing said locking means and for adjusting position of said one trip dog.

58. The rotary drive sprinkler of claim 46 wherein said spray nozzle defines a water flow path of generally upwardly converging geometry and extending angularly to a position offset relative to a centerline axis of said pop-up stem assembly and then curving to a relatively straight discharge section terminating in a discharge orifice through which the water is projected outwardly as the irrigation water stream.

59. The rotary drive sprinkler of claim 46 further including a hollow vacuum stem carried by said drive piston and extending upwardly therefrom to a position generally at the lower end of said pop-up stem assembly when said stem assembly is in the elevated spraying position, said vacuum stem being movable with said drive piston to induce an upward water flow preventing accumulation of grit and the like on said drive piston.

60. The rotary drive sprinkler of claim 46 wherein said housing includes a cover of plastic material, and further including a hood for said cover, said hood being formed from a resilient material comolded onto a skeletal plastic frame with at least some of said frame exposed for adhesive attachment to said cover.

61. The rotary drive sprinkler of claim 46 wherein said pop-up stem assembly includes a pop-up stem carrying said spray head and bearing means for supporting said stem for sliding movement between said retracted and elevated positions, said bearing means being eccentric with respect to a central axis of the pop-up stem assembly to offset reaction forces due to the outwardly projected water stream.

62. A rotary drive sprinkler, comprising:

a sprinkler housing having a water flow inlet;

a control valve for movement between closed and open positions respectively preventing and permitting water inflow into said housing through said water flow inlet;

a pressure reduction valve assembly responsive to water flow into said housing for dividing the water inflow into first and second flow portions at different pressures;

a spray head for outward projection of water from said housing; and drive means operated by said first and second flow portions for rotatably driving said spray head;

said pressure reduction valve assembly including spring means acting against said control valve to maintain said control valve in a closed position unless the pressure of the water at said inlet is at least a minimum threshold pressure, said spring means retracting from said control valve to unload said control valve in said open position.

63. The rotary drive sprinkler of claim 62 wherein said pressure reduction assembly includes a valve member, said spring means acting against said valve member to bear against said control valve when the water pressure at said inlet is below the minimum threshold pressure.

64. A protective cover for a sprinkler having an upper hosing cap, said cover comprising:

a skeletal frame selected from a material for secure attachment to the housing cap and having a size and shape to fit generally over the housing cap;

a resilient hood comolded upon said frame to substantially encase said frame leaving a portion thereof exposed for direct attachment to said cap.

65. The protective cover of claim 64, wherein said frame and the housing cap are formed from plastic material, and further including adhesive means for attaching said frame to the housing cap.

66. A reversing trip mechanism for a rotary drive sprinkler having a spray head and means for rotatably driving said spray head reversibly in forward and reverse drive directions, said trip mechanism comprising:

a trip lever engageable with said driving means and movable between first and second positions respectively placing said driving means in forward and reverse drive settings; and over-center spring means for maintaining said trip lever in a selected one of said first and second positions, said spring means having a pair of legs respectively anchored by said driving means and said trip lever, one of said driving means and said trip lever including an enlarged notch for relatively loosely anchoring said associated leg.

67. A spray nozzle for a sprinkler, comprising:

a spray nozzle housing defining an upward water flow path having an inlet portion centered generally on a vertical axis for receiving water flow from the sprinkler, said flow path extending upwardly from said inlet portion with a continuously converging geometry and extending angularly to a position offset in a rearward direction from the vertical axis and then curving to a relatively straight and forwardly open discharge section terminating in a discharge orifice through which the water is projected laterally outwardly and upwardly as a water stream.

68. In a pop-up sprinkler having a sprinkler housing with a water flow inlet and a pop-up stem carrying a spray head for projecting water laterally outwardly from the sprinkler, said stem being movable between a first position retracted substantially within the housing and a second position with the spray head elevated above the housing, a stem guide bearing, comprising:

bearing means for slidably guiding said stem throughout movement between said first and second positions relative to the housing, said bearing means being formed eccentrically relative to a vertical axis of the housing to offset said stem in a direction opposite to the direction of reaction force applied to said stem upon discharge of water laterally outwardly from said spray head, the magnitude of offset being selected whereby said stem is oriented in substantial alignment with said vertical axis upon discharge of water from said spray head.

69. In a sprinkler having a sprinkler housing formed from a plastic material, an improved water flow inlet construction, comprising:

an inlet fitting defining an inflow port for reception of water into the sprinkler housing, said inlet fitting including a pair of generally concentric cylindrical walls interconnected by a plurality of radially extending reinforcement webs.

70. The water flow inlet construction of claim 69 further including an annular ring interconnected between said walls in a generally axially centered position.

71. The water flow inlet construction of claim 69 wherein said inlet fitting is formed integrally with at least a portion of said housing.

* * * * *